US006854537B2

(12) United States Patent
Weholt

(10) Patent No.: US 6,854,537 B2
(45) Date of Patent: Feb. 15, 2005

(54) PORTABLE PLACER EXPLORATION AND SAMPLING APPARATUS

(76) Inventor: Raymond L. Weholt, 1432 N. Rio Aros, Green Valley, AZ (US) 85614

( * ) Notice: Subject to any disclaimer, the term of this patent is extended or adjusted under 35 U.S.C. 154(b) by 24 days.

(21) Appl. No.: 10/320,571

(22) Filed: Dec. 17, 2002

(65) Prior Publication Data

US 2004/0113482 A1 Jun. 17, 2004

(51) Int. Cl.[7] ..... E21B 7/18

(52) U.S. Cl. ..... 175/323; 175/394; 175/424; 299/17; 73/864.73

(58) Field of Search ..... 175/67, 323, 394, 175/424; 299/3, 8, 17; 73/864.73, 864.74

(56) References Cited

U.S. PATENT DOCUMENTS

| | | | | | |
|---|---|---|---|---|---|
| 656,994 | A | | 8/1900 | Munn | 37/63 |
| 1,071,199 | A | | 8/1913 | Andrews | 37/63 |
| 1,525,235 | A | | 2/1925 | Hansen | 37/63 |
| 1,533,465 | A | | 4/1925 | Rowe | 37/63 |
| 1,994,884 | A | * | 3/1935 | Chew | 175/67 |
| 2,255,167 | A | | 9/1941 | Hunn | 37/57 |
| 3,486,570 | A | | 12/1969 | Richardson | 175/5 |
| 3,790,213 | A | | 2/1974 | Grable | 299/8 |
| 3,856,355 | A | | 12/1974 | Grable | 299/8 |
| 3,917,326 | A | | 11/1975 | Grable | 299/8 |
| 3,961,671 | A | * | 6/1976 | Adams et al. | 175/57 |
| 4,140,346 | A | * | 2/1979 | Barthel | 299/17 |
| 4,336,849 | A | * | 6/1982 | Hug | 175/246 |
| 4,497,519 | A | | 2/1985 | Grable | 299/8 |

* cited by examiner

*Primary Examiner*—John Kreck

(57) ABSTRACT

A portable apparatus for exploration and sampling of placers which is capable of being disassembled for transport into areas not accessible to traditional sampling methods. The sampling unit operates on a principle of power augering and water jetting a sampling pipe to bedrock while concurrently recovering ¾" minus materials, including particles and nuggets of valuable minerals and gemstones, through a concentric center pipe, such recovery powered by a ring jet venturi and supplemented by a sample hole plug to increase the water pressure in the sampling hole.

11 Claims, 3 Drawing Sheets

PORTABLE PLACER EXPLORATION AND SAMPLING APPARATUS

References Cited—U.S. Patents

| | | | |
|---|---|---|---|
| 656994 | Aug. 28, 1900 | Munn | 37/63 |
| 1071199 | Aug. 26, 1913 | Andrews | 37/63 |
| 1533465 | Apr. 17, 1922 | Rowe | 37/63 |
| 1525235 | Feb. 3, 1925 | Hansen | 37/63 |
| 2255167 | Sep. 9, 1941 | Hunn | 37/57 |
| 3486570 | Dec. 30, 1969 | Richardson | 175/5 |
| 3790213 | Feb. 5, 1974 | Grable | 299/8 |
| 3856355 | Dec. 24, 1974 | Grable | 299/8 |
| 3917326 | Nov. 4, 1975 | Grable | 299/8 |
| 4497519 | Feb. 5, 1985 | Grable | 299/8 |

BACKGROUND OF THE INVENTION

This invention relates to a portable placer exploration and sampling apparatus designed for rapid and low-cost evaluation of valuable mineral content of alluvial, eluvial residual placers. Historically, placers have been one of the most important sources of precious minerals and gems such as gold, diamonds, platinum, emeralds, rubies and sapphires. Valuable minerals are not distributed uniformly through the typical placer deposit. Heavy minerals, in general, and gold, in particular, typically are confined to narrow, discontinuous pay streaks with little or no value between them and typically are concentrated at bedrock levels beneath a great amount of relatively barren overburden. Therefore, representative samples, although critical to exploration, selection and future development of placers are difficult to obtain.

Typically, land-based placer sampling methods have evolved into two categories—a large number of small samples or a lesser number of bulk samples. Small samples typically have been taken with gasoline powered churn drill, 6" drive pipe casing and sample baler. Bulk samples typically are taken by several methods, including hand dug excavation, machine-dug shafts, backhoe pits or trenches and bulldozer trenches.

With the exception of hand excavation, all of the above sampling methods are expensive and difficult, if not impossible, to transport into inaccessible areas. As a result, most placer development has occurred in the relatively accessible placer deposits of the world. One of the primary limitations on opening up virgin placer areas has, therefore, been the high cost of evaluating the economic risk and feasibility of further development of relatively inaccessible sites. This invention addresses this limitation by providing features which have not previously been available in traditional placer sampling methods, including

- light weight and ease of assembly of components permits sampling of placers considered inaccessible to traditional sampling methods,
- low capital and operating costs and simplicity of operation allows application of a large number of systems and employment of a large number of unskilled workers for wide scale testing of candidate placers,
- large sample volumes provide for increased sampling accuracy and, in many cases, financing of the sampling program through recovered precious mineral values,
- rapidly samples to bedrock without sloughing or handling of overburden,
- cleans and recovers materials trapped in bedrock cracks and fissures,

- enables sampling of mineral values from up to one and a half cubic foot per foot of depth to bedrock,
- maximizes sampled volume with minimum processing, i.e. only about 2% of sampled volume need be processed,
- reduces sampling costs to a fraction of traditional methods, and
- minimizes environmental damage.

To my knowledge, no prior art has been capable of providing all of the above functions, as a self-contained, integral unit, capable of being disassembled and transported into inaccessible areas. The references cited are described as large units adapted primarily for water-based operation from barges with land-based operation as an afterthought. Since most of the placers of the world are in areas inaccessible to motorized equipment, portability by means of manpower, pack animal, small boat or helicopter must be a prime consideration.

SUMMARY OF THE INVENTION

The present invention comprises an apparatus which operates on a principle of power augering and water jetting a sampling pipe to bedrock while concurrently recovering ¾" minus materials, including particles and nuggets of valuable minerals and gemstones, through a concentric center pipe, such recovery powered by a water ring jet venturi. Assuming the presence, and removal, of a reasonable percentage of ¾" minus materials, the jetting point and the auger will displace larger materials into the voids created by the removed materials, allowing a relatively unobstructed penetration to bedrock. The recovered materials and transport water are discharged into the manifold of a sampling sluice, leading to final determination of values by panning or other hydraulic concentrating device.

The sampling unit consists of a number of individual elements, as shown on the attached drawings, including

- two concentric pipes, with high pressure water connected to the annular space between the inner and outer pipe (FIG. 1),
- a rotary joint to allow rotation of the sampling pipe independent of the stationary high pressure water manifold (FIG. 1),
- a hydraulic drive unit mounted to the stationary water manifold and chain connected to a drive sprocket on the sampling pipe (FIG. 2),
- a single-turn auger helix near the lower extremity of the sampling pipe (FIG. 1) and immediately above a set of four high pressure spray nozzles (FIG. 5),
- a jetting head assembly at the lower extremity of the sampling pipe (FIG. 7) consisting of two high pressure jetting nozzles, an auger point, suction port screen, threaded attachment to the outer sampling pipe and a slip-fit annular ringjet venturi formed at the joining of the inner return pipe with the jetting head, and
- a sample hole plug assembly.

The combination of the above features results in a lightweight, integral unit which can be disassembled and transported into inaccessible candidate placers for rapid sampling to bedrock.

DESCRIPTION OF THE INVENTION

Figure 1:
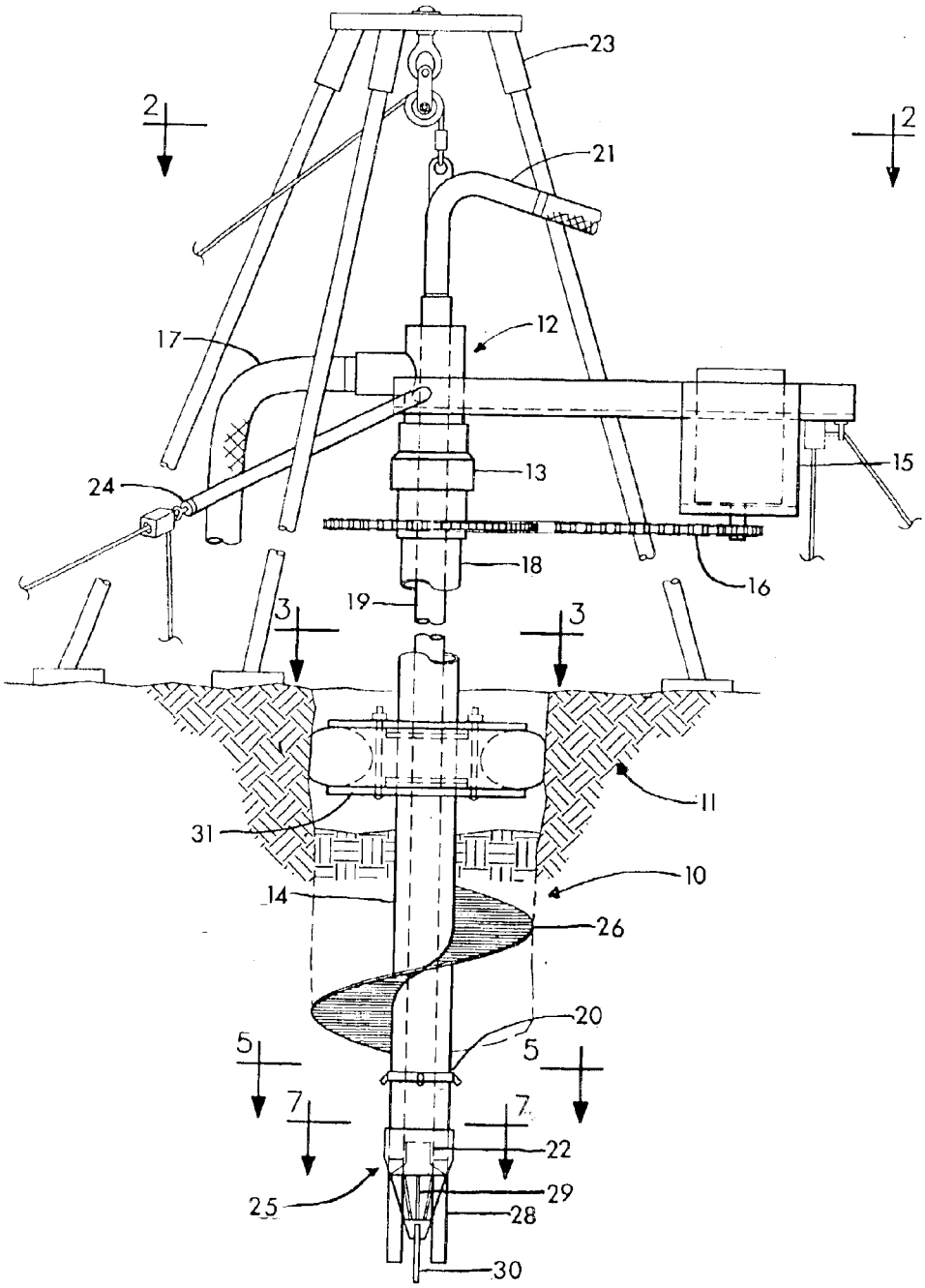
FIG. 1 is an elevation of the sampling unit consisting of a stationary water manifold, a rotary coupling and a hydraulic/chain driven sampling pipe. Not shown are the commercially available high pressure water pump which supplies water to the annular space between the outer and inner concentric pipes, the sampling sluice for concentrating materials recovered through the center return pipe and the hydraulic power unit which powers the rotary motion of the sampling pipe.

The preferred embodiment of the present invention is shown in FIG. 1, generally designated 10, penetrating into placer sand, gravel and cobble 11 to a depth of typically 5 to 20 ft. to bedrock. The three main components of the apparatus comprise a stationary water manifold assembly 12, a rotary coupling 13 and the sampling pipe assembly 14 which is capable of rotating motion, driven by the hydraulic motor 15 and chain assembly 16.

The stationary water manifold assembly 12 is comprised of a high-pressure water intake 17 supplied from a commercially available water pump (not shown), typically referred to as a fire pump. The high pressure water is introduced into the annular space between the concentric outer sampling pipe 18 and the inner return pipe 19 to service the high-pressure water sprays 20, the high-pressure water jets 28 and the ring jet venturi 22, such venturi creating the vacuum to recover and transport water and classified materials to the center return pipe 19 and thence a connection 21 to the manifold of a commercially available sampling sluice (not shown), leading to final determination of mineral and gemstone values by panning or other hydraulic concentrating device.

Attached to the water manifold assembly 12 is a support for the hydraulic drive motor 15, a tripod arrangement 23 to assist in setup and retrieval of the unit and tie-downs 24, as required to oppose the torque transmitted to the stationary utility head assembly. This tie-down arrangement may be replaced by two telescoping torque bars at 180° displacement and/or manual handle bars to control torque and to guide the unit for vertical penetration.

Figure 2:
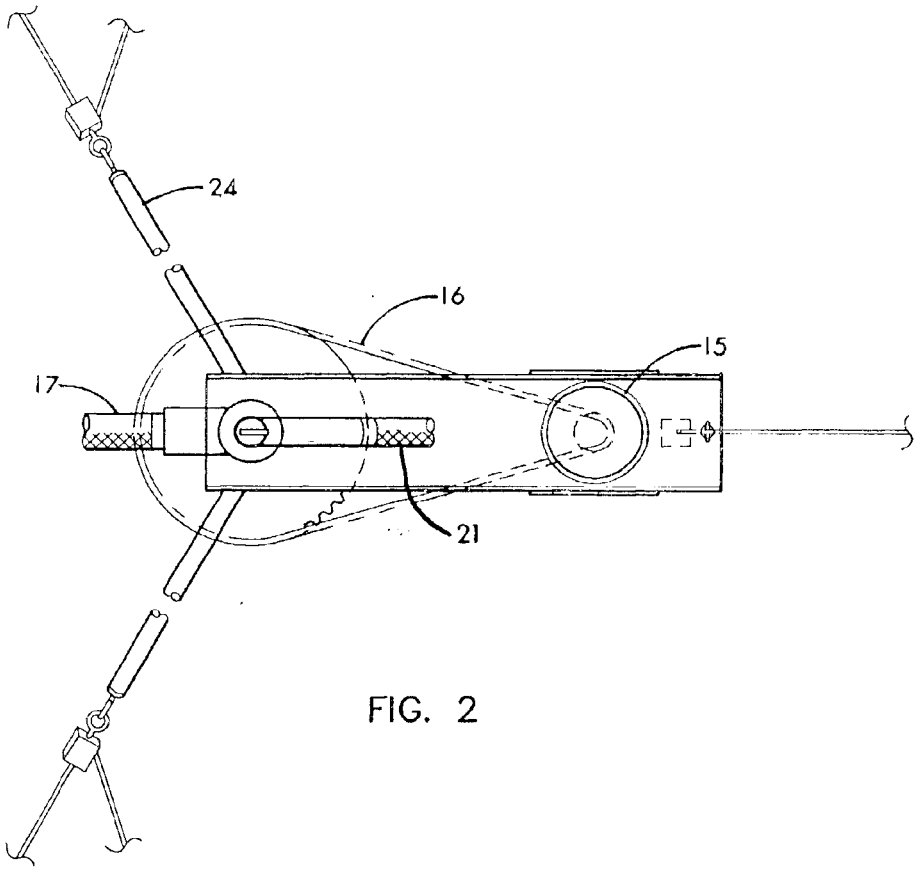
FIG. 2 is a plan view of the sampling pipe chain drive and the tie-downs which oppose the torque transmitted to the stationary water manifold.

The assembly to transmit rotary motion to the sampling pipe assembly 14, shown in plan view FIG. 2, comprises an hydraulic motor 15, supported to the stationary water manifold 12 and powered by a commercially available hydraulic power unit; a chain drive and sprocket assembly 16 to reduce speed and increase torque to the sampling pipe assembly 14; and a rotary coupling 13.

Figure 5:
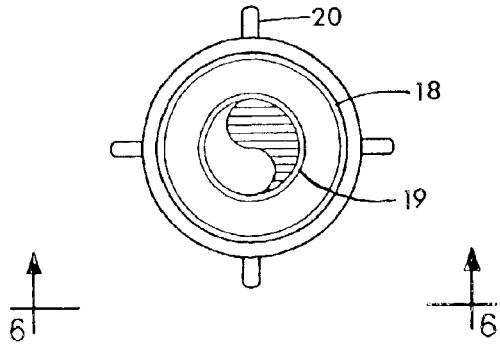
FIG. 5 is a sectional view of the sampling and return pipe, also showing location of the high-pressure spray nozzles.
Figure 6:
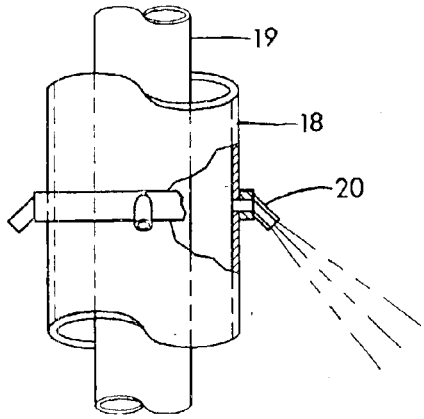
FIG. 6 is a partial elevation of the sampling and return pipes and the high-pressure spray nozzles.

The sampling pipe assembly 10 comprises concentric outer sampling pipe 18 and inner return pipe 19 with an annular space between as a means of supplying high pressure water to the spray jets 20, the jetting head 25 and the ring jet venturi 22; spray jets 20, shown in plan and elevation views in FIGS. 5 and 6, oriented at an angle to wash and assist in recovery of materials surrounding the sampling pipe 18 which, in turn, creates space for displacing the larger cobble; a single turn helix 26 attached to the sampling pipe 18 to create the downward force for penetration to bedrock; and a jetting head assembly 25 to provide a number of functions as described below. The sampling pipe 18 and the return pipe 19 can be extended by coupling additional five foot sections as the unit penetrates to bedrock.

Figure 7:
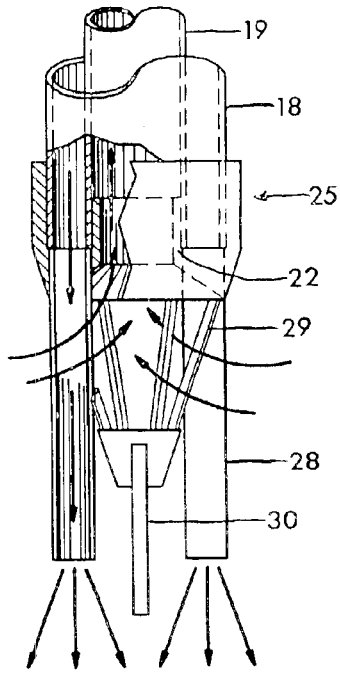
FIG. 7 is an elevation of the jetting head consisting of high-pressure jetting nozzles, the ring jet venturi which provides suction into the center return pipe, the suction port screen to classify recovered materials and an auger point for penetration of the soil to bedrock.

The jetting head assembly 25, shown in elevation and partial section in FIG. 7, comprises a machined body which creates the inner ring of the ring jet venturi 22 and the opening for recovery of materials through the center return pipe 19; adapts to the jetting nozzles 28 and the suction port screen bars 29; and includes a threaded connection to the sampling pipe 18. The jetting nozzles 28 create turbulence to assist in penetration to bedrock and create a water reservoir to transport materials to the return pipe 19 via the suction port screen 29, which classifies the materials to a size which will pass through the return pipe without plugging. An auger point 30 is attached to the lower extremity of the screen bars 29 and the jetting nozzles 28 to complete the screen bar assembly and assist in penetration to bedrock.

Figure 3:
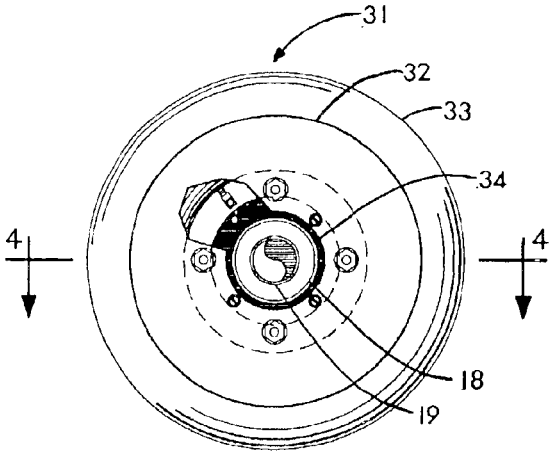
FIG. 3 is a plan view of the sampling hole plug.
Figure 4:
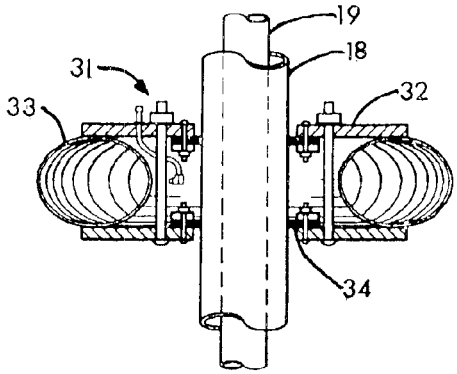
FIG. 4 is a sectional view of the sample hole plug.

A sample hole plug 31 is also incorporated to seal off the flow of excess water out of the top of the sample hole, both as a means of controlling water runoff and increasing water pressure in the sample hole to assist in recovery of materials through the return pipe 19. The sample hole plug 31, as shown in FIGS. 3 and 4, comprises two retainer plates 32 enclosing an oversize inner tube 33 which can be inflated to seal off the sample hole. Neoprene seals 34 are provided to seal off leakage around the sampling pipe 18. A relief valve may also be incorporated in the sample hole plug 31 to regulate the pressure in the sample hole and to facilitate operation on a closed-water cycle, wherein all of the discharged water would be retained in a settling tank which, in turn, would provide the main water supply supplemented by a small amount of makeup water.

The method of operation basically involves transport of the disassembled unit to a candidate placer by means of manpower, pack animal, small boat, helicopter, or similar means; reassembly of the unit and tripod; and raising the unit into vertical position by means of the winch attached to the tripod. Connections are made to the high-pressure water source, the return line to the sluice box and the hydraulic supply from the hydraulic power unit. As the unit is lowered by means of the winch, high pressure water (typically 200 gpm @ 60 psi) enters the connection at the top of the sampling unit and continues into the annular space between the outer pipe and the inner pipe. At the lower extremity of the unit, the high pressure water is released through the spray nozzles, the jetting nozzles and through the ring jet venturi into the inner return pipe. The high pressure spray and jets dislodge the smaller materials in the sampling hole which, in turn, are transported and drawn into the inner return pipe through the suction port screen.

The suction created by the ring jet venturi is assisted by the pressure increase in the sampling hole resulting from restriction of water outflow past the sample hole plug assembly. The rotation of the sampling pipe provides a dual function of clearing oversize material from the suction port screen and developing a downward force by means of the auger helix to assist in penetration to bedrock.

As the smaller materials are removed, space is created such that the jetting point can displace larger materials as it continues to penetrate to bedrock. The smaller materials which enter the suction ports are transported by high velocity water up the inner return pipe and released via a hose connection to a sampling sluice. The higher density materials, i.e. magnetite, gold flakes, nuggets and/or other valuable minerals and gemstones are retained by the sluice while barren sands and gravels are carried over and rejected. The denser particles retained by the sluice may be concentrated and visually inspected in the field by panning or other hydraulic concentrating device or, as an alternative, transported to home base for further concentration and laboratory analysis. The water from the sluice can either be wasted or returned to a settling basin for recirculation by means of a closed water loop.

The unit can be extended in 5 ft. increments, employing screw couplings on the inner return pipe and the outer pipe. Removal of the sampling unit is accomplished by reversing the power auger and lifting by means of a portable tripod and cable hoist.

What is claimed is:

1. An apparatus for sampling placers to bedrock which can be disassembled for transport into areas not accessible to traditional placer sampling methods, such apparatus comprising (a) an outer supply pipe to deliver pressurized water to the sampling zone, (b) a concentric inner return pipe to recover transport water and classified materials from the sampling zone, (c) a tripod and winch to assist in setup and retrieval of the unit, (d) a stationary water manifold assembly to provide connections for the high-pressure supply water and the return pipe for material recovery, (e) tie-downs, telescoping torque bars and/or manual handle bars as required to oppose the torque transmitted to the stationary utility head assembly and to guide the unit for vertical penetration, (f) a rotary coupling to connect the stationary water manifold to the rotating sampling pipe, (g) an hydraulic drive motor, chain and sprocket arrangement to provide low-speed, high torque rotation of the sampling pipe, (h) a single turn helix attached to a lower extremity of the sampling pipe to provide a downward force for penetration to bedrock, (i) high-pressure spray nozzles at a lower extremity of the sampling pipe to wash the surrounding soil, assist in retrieval of smaller particles and create voids for displacement of larger cobble to allow further penetration to bedrock, (j) a jetting head at the lower extremity of the unit which provides the multiple functions of a ring jet venturi, a suction port screen, jetting nozzles and an auger point, and (k) a sample hole plug to control flow of excess water and increase water pressure in the sampling hole.

2. The apparatus of claim 1 wherein couplings are provided on the concentric pipes at five foot increments to assist in transport, setup and extension to bedrock.

3. The apparatus of claim 2 wherein set screws are provided at the outer pipe couplings to eliminate uncoupling of the sampling pipe during retrieval.

4. The apparatus of claim 1 wherein said high-pressure spray nozzles are of appropriate number and configuration to thoroughly wash and separate the smaller particles from the surrounding soil as the sampling pipe rotates.

5. The apparatus of claim 1 wherein said jetting head forms a ring jet venturi when joined to the lower extremity of the sampling and return pipe as a means of providing the vacuum and suction of transport water and classified materials into the return pipe.

6. The apparatus of claim 1 wherein said jetting head incorporates a suction port screen comprising metal bars spaced as to allow passage of classified material limited to such size as to preclude plugging of the return pipe.

7. The apparatus of claim 1 wherein said jetting nozzles are of such size and configuration to create turbulence in the sampling zone, to assist in penetration to bedrock and to create a water reservoir for transport of materials to the return pipe.

8. The apparatus of claim 1 wherein said auger point is of such size and configuration to assist in penetration to bedrock.

9. The apparatus of claim 1 wherein a sample hole plug is incorporated to seal off the flow of excess water out of the top of the sample hole, both as a means of controlling water runoff and increasing water pressure in the sample hole to assist in recovery of materials through the return pipe.

10. The apparatus of claim 9 wherein said sample hole plug comprises two retainer plates and seals enclosing an oversize inner tube which can be inflated to seal off the sample hole.

11. The apparatus of claim 9 wherein a relief valve may be incorporated in the sample hole plug to regulate the pressure in the sample hole and to facilitate operation on a closed-water cycle, thereby retaining discharged water in a settling basin which, in turn, would provide the main water supply supplemented by a small amount of makeup water.

* * * * *